US011764533B2

(12) United States Patent
Sato et al.

(10) Patent No.: US 11,764,533 B2
(45) Date of Patent: Sep. 19, 2023

(54) MANUFACTURING METHOD OF ELECTRIC WIRE WITH TERMINAL, MANUFACTURING DEVICE OF ELECTRIC WIRE WITH TERMINAL, AND ELECTRIC WIRE WITH TERMINAL

(71) Applicant: YAZAKI CORPORATION, Tokyo (JP)

(72) Inventors: Tomoya Sato, Makinohara (JP); Hiroya Kousaka, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 7 days.

(21) Appl. No.: 17/676,044

(22) Filed: Feb. 18, 2022

(65) Prior Publication Data

US 2022/0271486 A1 Aug. 25, 2022

(30) Foreign Application Priority Data

Feb. 19, 2021 (JP) ..... 2021-025339

(51) Int. Cl.
*H01R 43/048* (2006.01)
*H01B 7/02* (2006.01)
*H01R 4/18* (2006.01)

(52) U.S. Cl.
CPC ..... *H01R 43/048* (2013.01); *H01B 7/02* (2013.01); *H01R 4/185* (2013.01)

(58) Field of Classification Search
CPC ..... H01R 4/62; H01R 4/185; H01R 4/188; H01R 43/048; H01R 43/055; H01B 7/02;
(Continued)

(56) References Cited

U.S. PATENT DOCUMENTS 6,513,235 B1 * 2/2003 Ohsumi ..... H01R 4/185 29/857
8,870,611 B2 * 10/2014 Sato ..... H01R 4/185 439/442

(Continued)

FOREIGN PATENT DOCUMENTS

JP 2018-73768 A 5/2018
JP 2018-137135 A 8/2018

*Primary Examiner* — William H. Mayo, III
(74) *Attorney, Agent, or Firm* — KENEALY VAIDYA LLP

(57) ABSTRACT

A manufacturing method of an electric wire with terminal includes a crimping step of crimping first and second fastening portions of a terminal to a conductor core wire and an insulating coating, while moving a crimping jig in a predetermined movement direction. The crimping jig includes first and second crimpers configured to crimp the first and second fastening portions, such that a width of the first fastening portion after crimping is larger than a width of the second fastening portion after crimping. The second crimper includes a fastening surface configured to fasten the second fastening portion at the time of crimping, a side surface facing the first crimper, and an inclined surface expanding in a width direction as approaching the first crimper so as to chamfer a boundary portion between the fastening surface and the side surface. The inclined surface faces an intermediate portion in the crimping step.

6 Claims, 7 Drawing Sheets

(58) Field of Classification Search
CPC ... H01B 7/04; H01B 7/08; H01B 7/10; H01B 43/16
USPC ..... 174/74 R, 78, 84 R, 84 C, 88 C; 439/421, 423, 442, 488, 877–884; 29/279, 281, 747, 748, 751, 753, 761, 29/861, 863, 869, 874, 877, 882, 884, 29/885
See application file for complete search history.

(56) References Cited

U.S. PATENT DOCUMENTS

| | | | | |
|---|---|---|---|---|
| 2011/0223799 | A1* | 9/2011 | Hasebe | H01R 13/465 439/488 |
| 2018/0131104 | A1 | 5/2018 | Kudo | |
| 2020/0014130 | A1* | 1/2020 | Sato | H01R 4/62 |

* cited by examiner

MANUFACTURING METHOD OF ELECTRIC WIRE WITH TERMINAL, MANUFACTURING DEVICE OF ELECTRIC WIRE WITH TERMINAL, AND ELECTRIC WIRE WITH TERMINAL

CROSS-REFERENCE TO RELATED APPLICATIONS

This application is based on and claims priority under 35 USC 119 from Japanese Patent Application No. 2021-025339 filed on Feb. 19, 2021, the contents of which are incorporated herein by reference.

TECHNICAL FIELD

The present invention relates to a method for manufacturing an electric wire with terminal in which a terminal is attached to an end of an electric wire, a manufacturing device of an electric wire with terminal, and an electric wire with terminal.

In the related art, a manufacturing method of an electric wire with terminal has been proposed in which a terminal is crimped to be fastened and fixed to an end of an electric wire. In this type of manufacturing method, a crimping jig including an indenter (so-called anvil and crimper) that crimps a fastening portion of a terminal while deforming the fastening portion so as to surround a conductor core wire of an electric wire is typically used (see, for example, Patent Literature 1).

CITATION LIST

Patent Literature

Patent Literature 1: JP-2018-073768-A

However, when the crimping as described above is performed, depending on a structure of the terminal and a shape of the crimping jig (in particular, a crimper), the terminal and the crimping jig come into contact with each other and rub against each other at the time of crimping, and thus a scratch such as a scrape or a recess may be generated on a surface of the terminal. Such the scratch may grow into a large crack due to an external force such as vibration exerted on a manufactured electric wire with terminal when the electric wire with terminal is actually used. The crack generated in the terminal may cause unintended breakage such as deformation or cracking of the terminal. From the viewpoint of increasing reliability of electrical connection between the terminal and the electric wire, it is desirable to prevent such unintended breakage of the terminal.

SUMMARY OF INVENTION

The present invention has been made in view of the above circumstances, and an object thereof is to provide a manufacturing method of an electric wire with terminal, a manufacturing device of an electric wire with terminal, and an electric wire with terminal, which can improve reliability of electrical connection between a terminal and an electric wire.

According to an embodiment, a manufacturing method of an electric wire with terminal is used for manufacturing an electric wire with terminal in which a terminal is attached to an end of an electric wire.

The electric wire includes a conductor core wire and an insulating coating covering an outer periphery of the conductor core wire, and the terminal includes a first fastening portion crimped so as to surround the conductor core wire, a second fastening portion crimped so as to surround the insulating coating, and an intermediate portion connecting the first fastening portion and the second fastening portion.

The manufacturing method includes a preparation step of positioning the electric wire and the terminal such that the conductor core wire is placed on the first fastening portion and the insulating coating is placed on the second fastening portion, and a crimping step of crimping the first fastening portion to the conductor core wire and crimping the second fastening portion to the insulating coating while moving a crimping jig in a predetermined movement direction.

The crimping jig includes a first crimper and a second crimper configured to crimp the first fastening portion and the second fastening portion, respectively, such that a width of the first fastening portion after crimping is larger than a width of the second fastening portion after crimping in a width direction intersecting the movement direction. The second crimper includes a fastening surface configured to fasten the second fastening portion while guiding the second fastening portion toward the insulating coating, a side surface facing the first crimper, and an inclined surface expanding in the width direction as approaching the first crimper so as to chamfer a boundary portion between the fastening surface and the side surface.

The inclined surface faces the intermediate portion in the crimping step.

In addition, according to another embodiment, a manufacturing device of an electric wire with terminal is used for manufacturing an electric wire with terminal in which a terminal is attached to an end of an electric wire.

The electric wire includes a conductor core wire and an insulating coating covering an outer periphery of the conductor core wire. The terminal includes a first fastening portion crimped so as to surround the conductor core wire, a second fastening portion crimped so as to surround the insulating coating, and an intermediate portion connecting the first fastening portion and the second fastening portion.

The manufacturing device includes a crimping jig configured to crimp the first fastening portion to the conductor core wire and crimp the second fastening portion to the insulating coating while moving in a predetermined movement direction. The crimping jig includes a first crimper and a second crimper configured to crimp the first fastening portion and the second fastening portion, respectively, such that a width of the first fastening portion after crimping is larger than a width of the second fastening portion after crimping in a width direction intersecting the movement direction. The second crimper includes a fastening surface configured to fasten the second fastening portion while guiding the second fastening portion toward the insulating coating, a side surface facing the first crimper, and an inclined surface expanding in the width direction as approaching the first crimper so as to chamfer a boundary portion between the fastening surface and the side surface.

The inclined surface faces the intermediate portion when the first fastening portion and the second fastening portion are crimped.

Further, according to yet another embodiment, there is provided an electric wire with terminal in which a terminal is attached to an end of an electric wire.

The electric wire includes a conductor core wire and an insulating coating covering an outer periphery of the conductor core wire. The terminal is made of a metal plate material provided with a plating material so as to cover a surface of a base material, and includes a first fastening portion crimped so as to surround the conductor core wire, a second fastening portion crimped so as to surround the insulating coating, and an intermediate portion connecting the first fastening portion and the second fastening portion. The intermediate portion has, on a surface of the plating material, a sliding mark that extends along a circumferential direction surrounding the electric wire and does not expose the base material.

BRIEF DESCRIPTION OF DRAWINGS

FIGS. 1A and 1B illustrate a main part of an electric wire with terminal according to an embodiment of the present invention, in which FIG. 1A is a plan view thereof, and FIG. 1B is a side view thereof;

FIGS. 4A and 4B illustrate a second crimper of the crimping jig, in which FIG. 4A is a perspective view thereof, and FIG. 4B is a front view thereof:

DESCRIPTION OF EMBODIMENTS

Figure 1A:
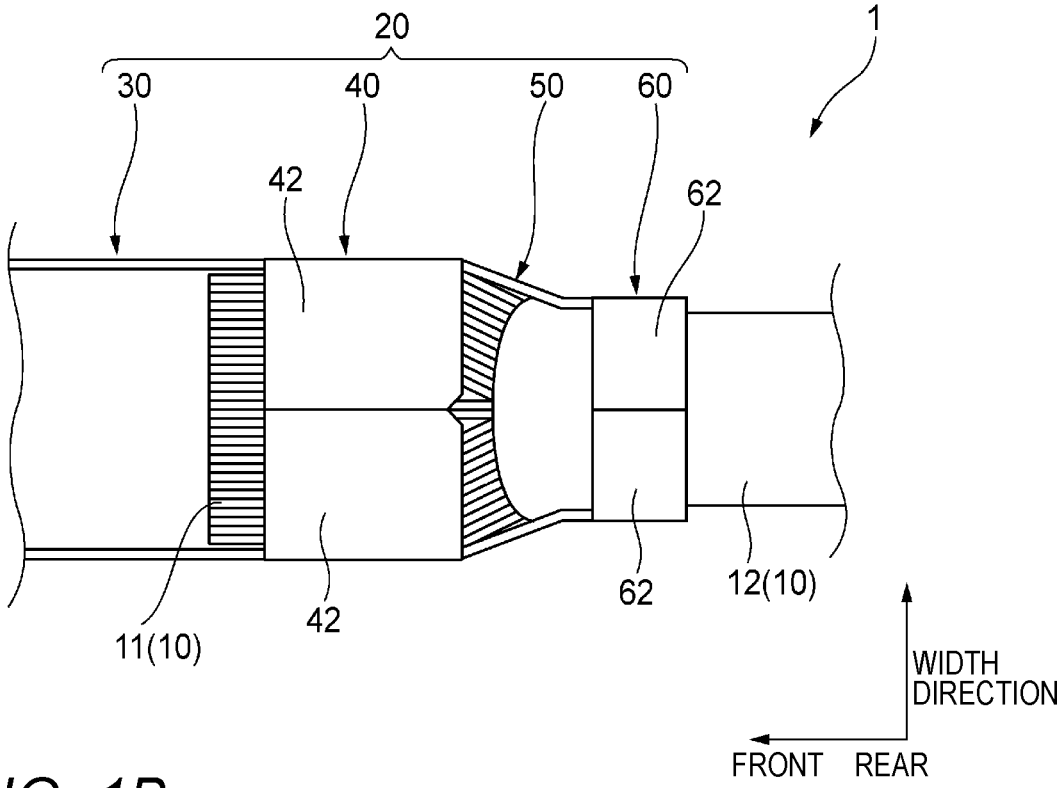

Hereinafter, an electric wire with terminal 1 according to an embodiment of the present invention will be described with reference to FIGS. 1A to 6. As shown in FIG. 1 and the like, the electric wire with terminal 1 is formed by attaching (crimping) a terminal 20 to an end of an electric wire 10. In the electric wire with terminal 1, the electric wire 10 and the terminal 20 are electrically connected to each other.

Hereinafter, for convenience of explanation, as shown in FIGS. 1A to 6, "front-rear direction", "width direction", "up-down direction", "front", "rear", "up", and "down" are defined. The "front-rear direction", the "width direction", and the "up-down direction" are orthogonal to one another. The front-rear direction coincides with an extending direction of the electric wire with terminal 1 (more specifically, the terminal 20), and a front side and a rear side respectively correspond to a tip end side and a base end side of the terminal 20. The width direction coincides with the "width direction" in the present invention, and the up-down direction coincides with a "movement direction" in the present invention. Hereinafter, members constituting the electric wire with terminal 1 will be described in order.

Figure 1B:
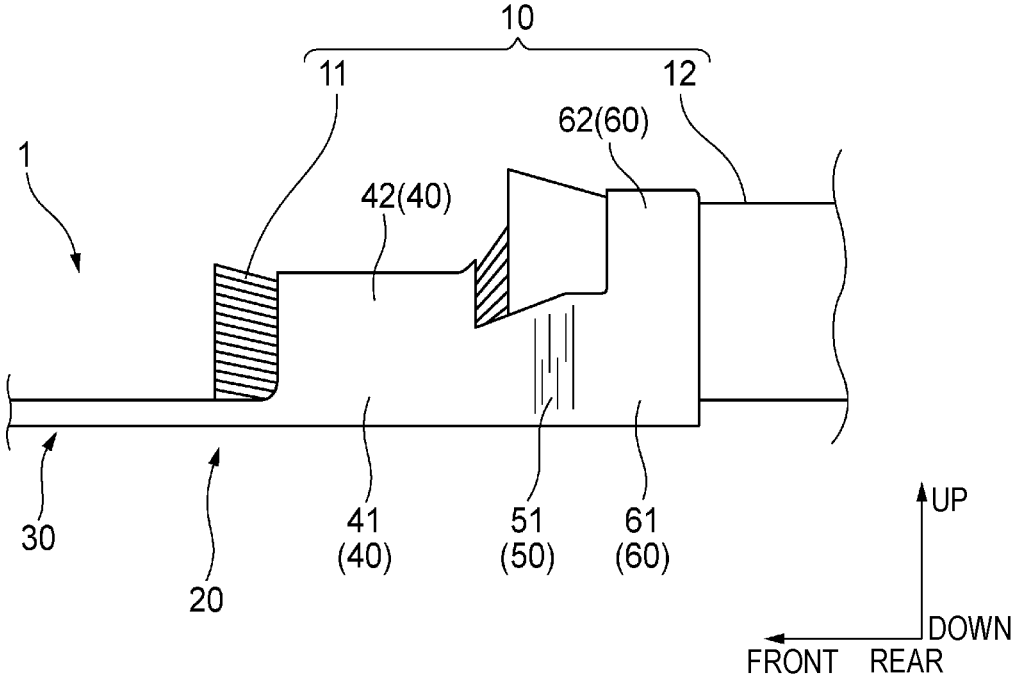
Figure 3:
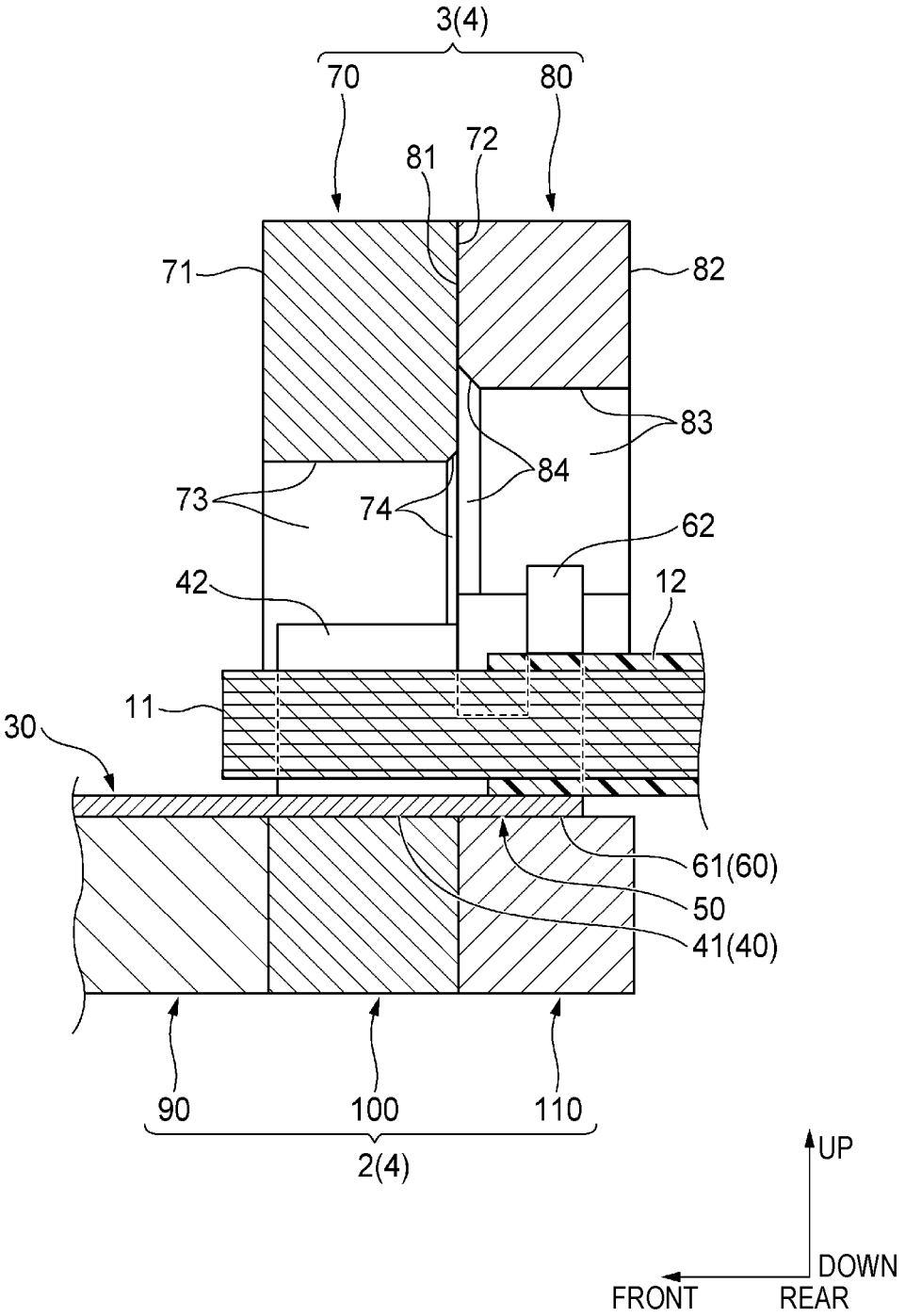
FIG. 3 is a cross-sectional view taken along a line A-A in FIG. 2.

First, the electric wire 10 will be described. As shown in FIGS. 1A, 1B, 3, and the like, the electric wire 10 includes a conductor core wire 11 and an insulating coating 12 covering an outer periphery of the conductor core wire 11. In this example, the conductor core wire 11 is an aggregate of a plurality of wires. Each wire is formed of a conductive metal such as copper or aluminum. The insulating coating 12 is made of an insulating resin. As preparation for crimping the terminal 20 to the electric wire 10, the insulating coating 12 is removed at a tip end portion of the electric wire 10, and the conductor core wire 11 is exposed by a predetermined length.

Next, the terminal 20 will be described. In this example, the terminal 20 is formed by performing pressing, bending, and the like on a metal plate material in which a surface of a conductive metal plate (for example, a copper plate or a copper alloy) as a base material is covered with a plating material (for example, a plating material such as tin). As shown in FIG. 1A, the terminal 20 includes a terminal connecting portion (not shown) with a mating terminal, a coupling portion 30, a first fastening portion 40, an intermediate portion 50, and a second fastening portion 60. The terminal connecting portion, the coupling portion 30, the first fastening portion 40, the intermediate portion 50, and the second fastening portion 60 are arranged in a row along the front-rear direction from the front side toward the rear side in this order. In this example, the terminal 20 having a shape with the terminal connecting portion will be described continually as a typical example, but the present invention can also be applied to a terminal having another shape such as a relay terminal for connecting two electric wires to each other.

Figure 2:
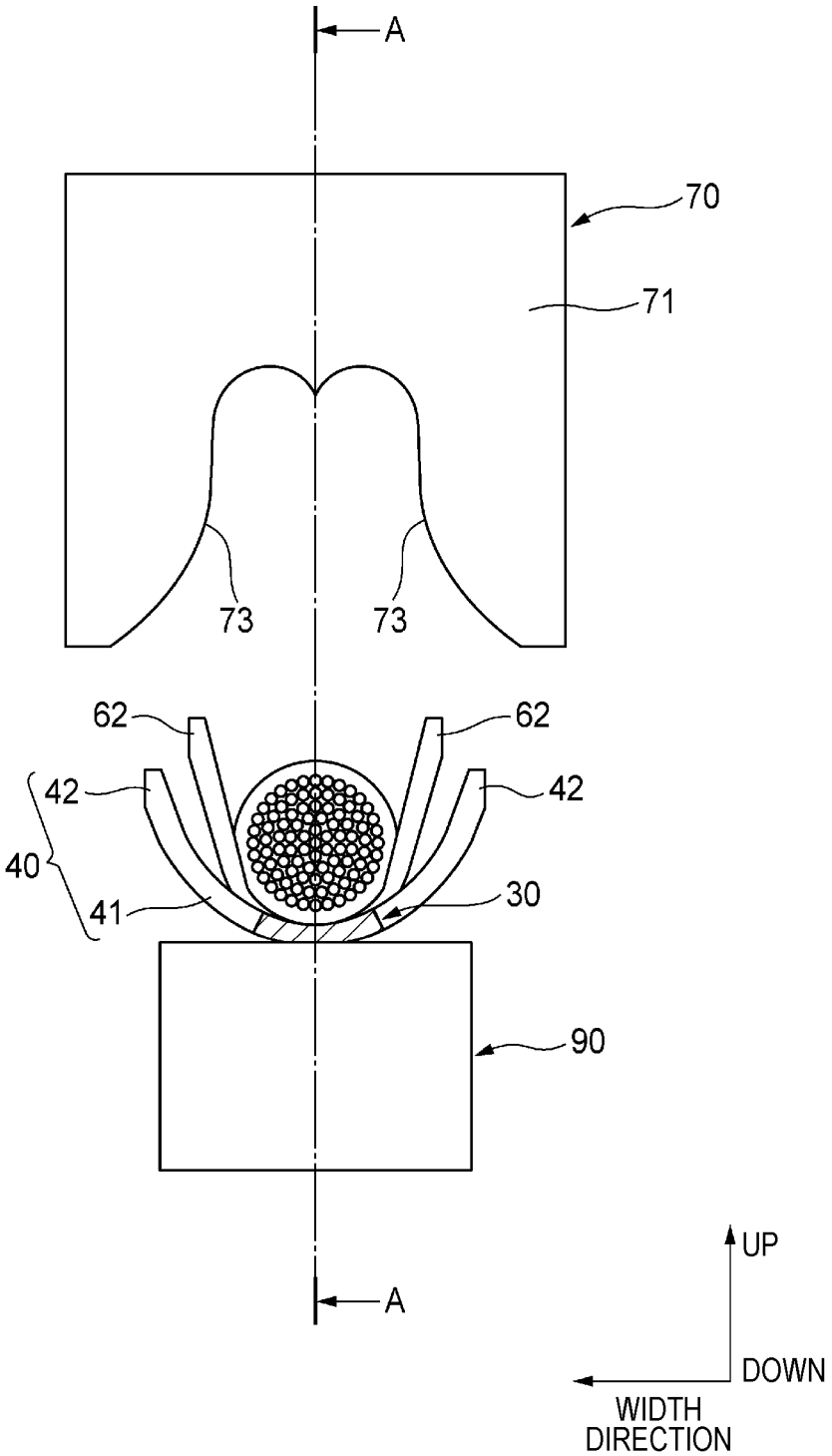
FIG. 2 is a front view illustrating a state before a fastening portion of a terminal is crimped to an electric wire using a crimping jig.

The terminal connecting portion is a portion of the terminal 20 to be connected to the mating terminal. The terminal connecting portion is connected to the first fastening portion 40 via the coupling portion 30. The first fastening portion 40 is a portion to be crimped to the exposed conductor core wire 11 of the electric wire 10. As shown in FIGS. 1A, 1B, and 2, the first fastening portion 40 includes a bottom portion 41 and a pair of fastening pieces 42. The bottom portion 41 has a substantially U-shaped cross section (perpendicular to the front-rear direction) that opens upward, and extends in the front-rear direction. The pair of fastening pieces 42 have an arm shape extending upward from a pair of end portions of the bottom portion 41 in the width direction. As shown in FIG. 2, the pair of fastening pieces 42 extend upward while being inclined outward in the width direction in a state before being crimped to the conductor core wire 11.

The second fastening portion 60 is a portion to be crimped to an end portion of the insulating coating 12 of the electric wire 10. As shown in FIGS. 1A, 1B, and 2, the second fastening portion 60 includes a bottom portion 61 and a pair of fastening pieces 62. The bottom portion 61 has a substantially U-shaped cross section (perpendicular to the front-rear direction) that opens upward, and extends in the front-rear direction. The pair of fastening pieces 62 have an arm shape extending upward from a pair of end portions of the bottom portion 61 in the width direction. As shown in FIG. 2, the pair of fastening pieces 62 extend upward while being inclined outward in the width direction in a state before being crimped to the insulating coating 12.

The intermediate portion 50 is a portion that connects the bottom portion 41 of the first fastening portion 40 and the bottom portion 61 of the second fastening portion 60 in the front-rear direction. Like the bottom portion 41 and the bottom portion 61, the intermediate portion 50 has a substantially U-shaped cross section (perpendicular to the front-rear direction) that opens upward, and extends in the front-rear direction.

Figure 6A:
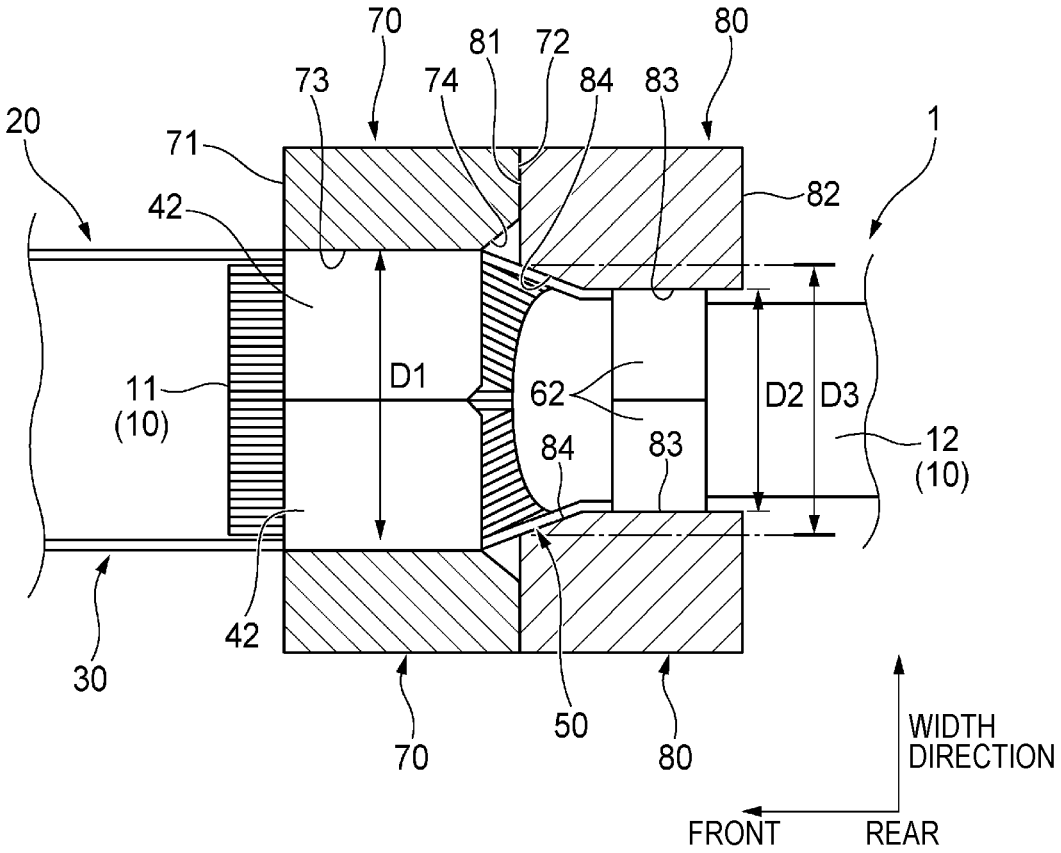
FIG. 6A is a view corresponding to a cross section of B-B in FIG. 5, and illustrating the state in which the fastening portion of the terminal is crimped to the electric wire using the crimping jig.
Figure 6B:
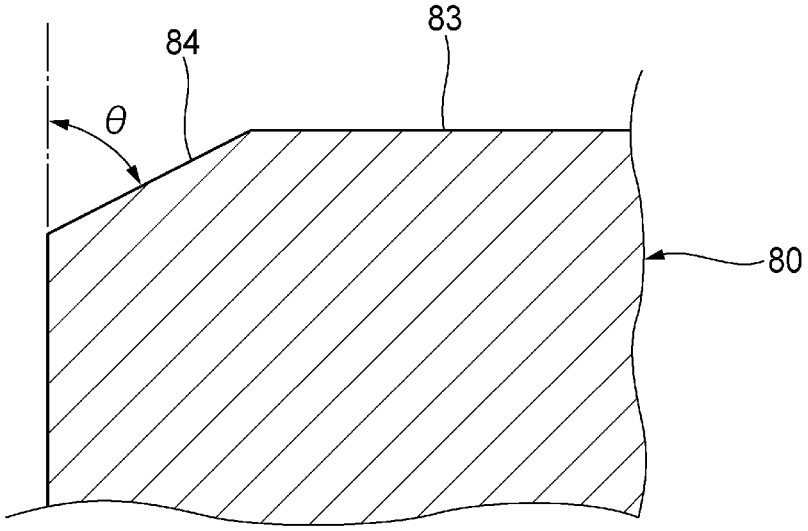
FIG. 6B is an enlarged view of a part of the second crimper shown in FIG. 6A.

Here, as shown in FIG. 6A, a width of the bottom portion 41 of the first fastening portion 40 after crimping is larger than a width of the bottom portion 61 of the second fastening portion 60 after crimping. Therefore, the intermediate portion 50 has a shape in which a width thereof decreases from the first fastening portion 40 toward the second fastening portion 60. The members constituting the electric wire with terminal 1 have been described above.

Next, a procedure for crimping the terminal 20 to the electric wire 10 will be described. The crimping of the terminal 20 to the electric wire 10 is performed using a crimping jig 4 shown in FIG. 3. The crimping jig 4 includes an anvil 2 and a crimper 3. The anvil 2 is a fixed mold and has a function of supporting the terminal 20. The crimper 3 is a movable mold located above the anvil 2, and is movable in the up-down direction relative to the anvil 2.

As shown in FIG. 3, the crimping jig 4 includes a front anvil 90, a first anvil 100, and a second anvil 110 as the anvil 2. The front anvil 90, the first anvil 100, and the second anvil 110 are arranged in a row along the front-rear direction from the front side toward the rear side in this order. The front anvil 90 has a function of supporting the terminal connecting portion (not shown) and the coupling portion 30 of the terminal 20. The first anvil 100 has a function of supporting the first fastening portion 40 of the terminal 20. The second anvil 110 has a function of supporting the intermediate portion 50 and the second fastening portion 60 of the terminal 20.

The crimping jig 4 includes a first crimper 70 and a second crimper 80 as the crimper 3. The first crimper 70 is disposed to face the first anvil 100 in the up-down direction, and has a function of fastening the pair of fastening pieces 42 of the first fastening portion 40 to crimp the first fastening portion 40 to the conductor core wire 11. The second crimper 80 is disposed to face the second anvil 110 in the up-down direction, and has a function of fastening the pair of fastening pieces 62 of the second fastening portion 60 to crimp the second fastening portion 60 to the insulating coating 12.

As shown in FIGS. 2 and 3, the first crimper 70 has a flat plate shape having a thickness equal to an interval between a front surface 71 and a rear surface 72, and is formed with a fastening surface 73 recessed upward in a central portion of an underside thereof in the width direction. Further, an inclined surface 74 is formed over an entire region of a boundary portion between the fastening surface 73 and the rear surface 72 so as to chamfer the boundary portion (see also FIG. 6A). The inclined surface 74 is inclined with respect to an axis of the terminal 20 (for example, a left-right direction of a paper surface in FIG. 6A), and is inclined to expand in the width direction as approaching the second crimper 80 in a vicinity of a side surface of the terminal 20.

The fastening surface 73 is formed to guide and fasten the pair of fastening pieces 42 of the first fastening portion 40 of the terminal 20. By adopting the fastening surface 73 having a shape shown in FIG. 2, the pair of fastening pieces 42 are fastened so as to surround the conductor core wire 11 and to bite into an upper portion of the conductor core wire 11 while a pair of tip ends of the fastening pieces 42 facing downward are in contact with each other.

Figure 4A:
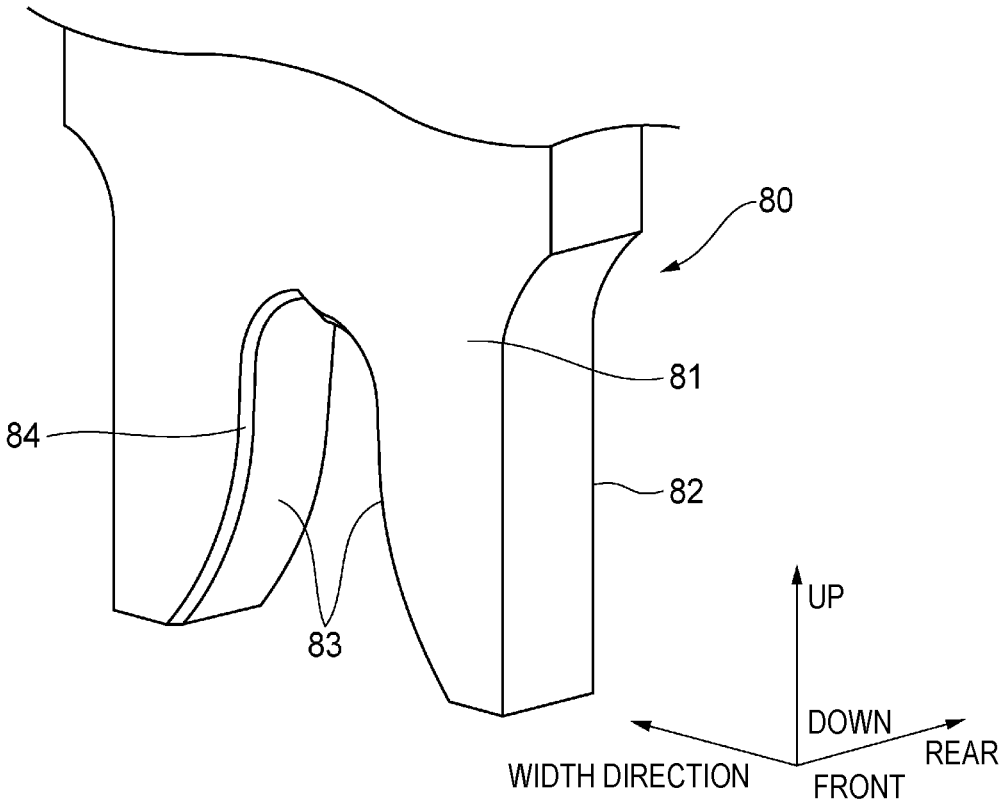
Figure 4B:
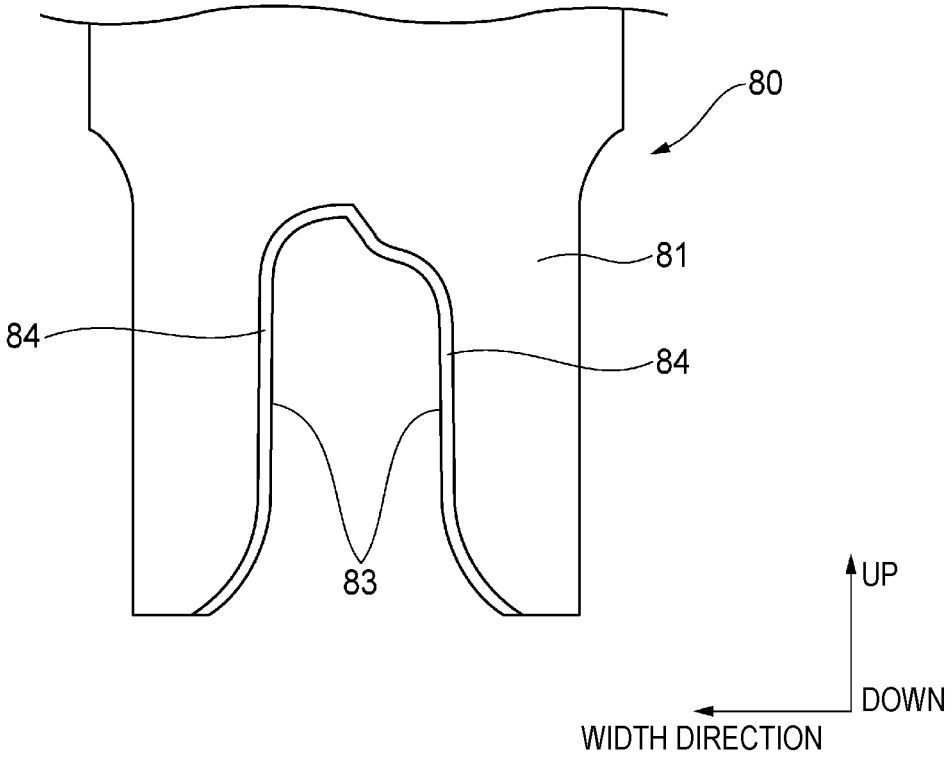

As shown in FIGS. 3, 4A, and 4B, the second crimper 80 has a flat plate shape having a thickness equal to an interval between a front surface 81 and a rear surface 82, and is formed with a fastening surface 83 recessed upward in a central portion of an underside thereof in the width direction. Further, an inclined surface 84 is formed over an entire region of a boundary portion between the fastening surface 83 and the front surface 81 so as to chamfer the boundary portion (see also FIG. 6A). The inclined surface 84 is inclined with respect to the axis of the terminal 20 (for example, the left-right direction of the paper surface in FIG. 6A), and is inclined to expand in the width direction as approaching the first crimper 70 in the vicinity of the side surface of the terminal 20 (particularly, a vicinity of the intermediate portion 50). A chamfer angle θ (see FIG. 6B) of the inclined surface 84 is preferably 45° or more. The inclined surface 84 faces (comes into contact with) outer surfaces of a pair of end portions of the intermediate portion 50 in the width direction at the time of crimping. An effect of formation of the inclined surface 84 will be described later.

The fastening surface 83 is formed to guide and fasten the pair of fastening pieces 62 of the second fastening portion 60 of the terminal 20. By adopting the fastening surface 83 having a shape shown in FIGS. 4A and 4B, the pair of fastening pieces 62 are fastened so as to surround the insulating coating 12 and to cause a tip end portion of the left fastening piece 62 to overlay (overlap) an upper side of a tip end portion of the right fastening piece 62 when viewed from the front.

As shown in FIG. 6A, an interval D1 in the width direction between a pair of portions of the fastening surface 73 of the first crimper 70 is larger than an interval D2 in the width direction between a pair of portions of the fastening surface 83 of the second crimper 80. The pair of portions of the fastening surface 73 face (come into contact with) outer surfaces of the pair of end portions of the bottom portion 41 of the first fastening portion 40 in the width direction at the completion of crimping, and the pair of portions of the fastening surface 83 face (come into contact with) outer surfaces of the pair of end portions of the bottom portion 61 of the second fastening portion 60 in the width direction at the completion of crimping. That is, D1>D2. This case corresponds to the matter that the width of the bottom portion 41 of the first fastening portion 40 is larger than the width of the bottom portion 61 of the second fastening portion 60.

Further, as shown in FIG. 6A, the interval D1 is larger than an interval D3 in the width direction between a pair of portions at a boundary portion between the front surface 81 and the inclined surface 84 of the second crimper 80, and the pair of portions at the boundary portion face (come into contact with) the outer surfaces of the pair of end portions of the intermediate portion 50 in the width direction at the completion of crimping. That is, D1>D3.

As shown in FIGS. 3 and 6A, the first crimper 70 and the second crimper 80 are arranged adjacently in the front-rear direction such that the rear surface 72 of the first crimper 70 and the front surface 81 of the second crimper 80 are in contact with each other.

When the terminal 20 is to be crimped to the electric wire 10, first, as shown in FIG. 3, the terminal 20 is placed on the anvil 2 such that the terminal connecting portion and the coupling portion 30 are supported by the front anvil 90, the first fastening portion 40 is supported by the first anvil 100, and the intermediate portion 50 and the second fastening portion 60 are supported by the second anvil 110 (a preparation step).

Next, the electric wire 10 is placed on the terminal 20 such that the exposed conductor core wire 11 is supported by the bottom portion 41 of the first fastening portion 40 and the insulating coating 12 is supported by the bottom portion 61 of the second fastening portion 60 (the preparation step).

Figure 5:
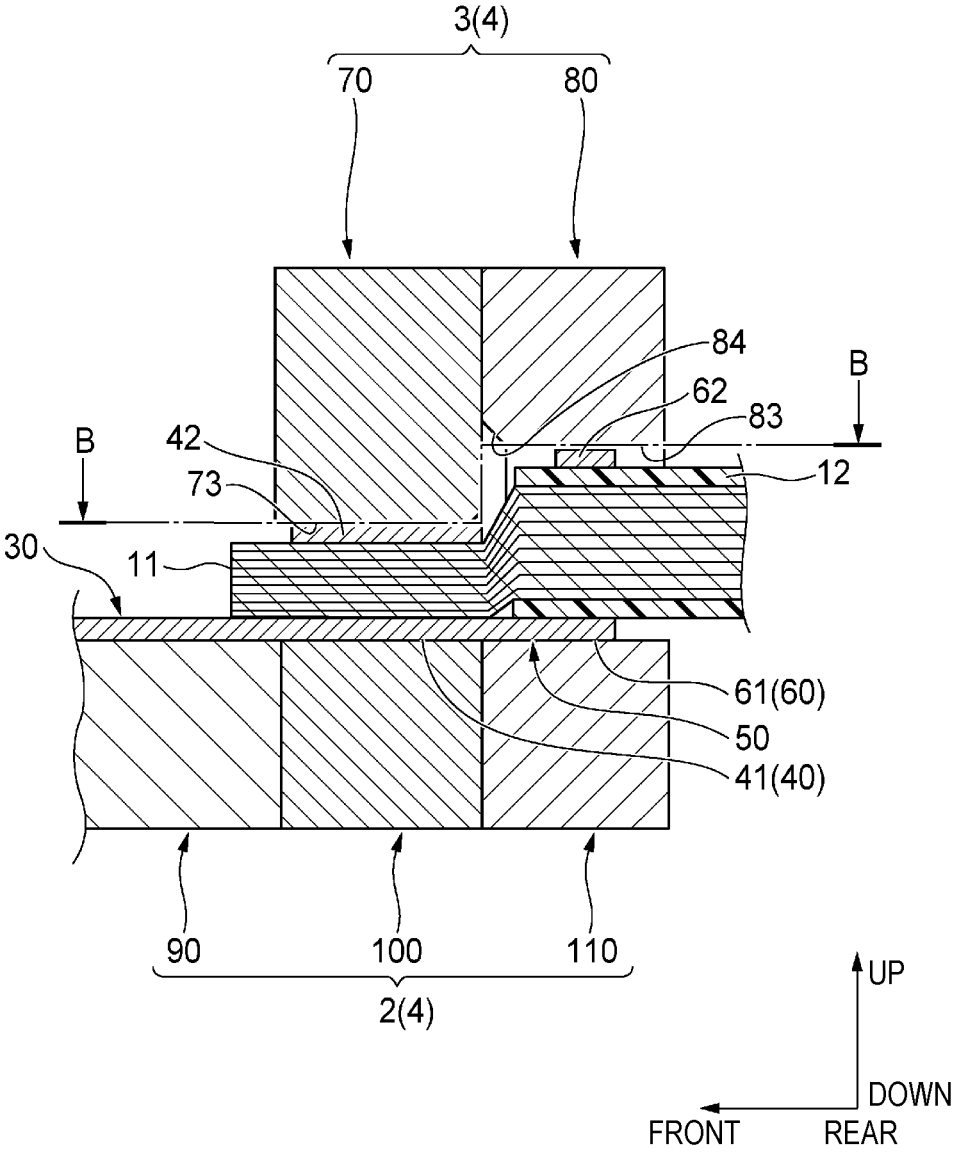
FIG. 5 is a view corresponding to FIG. 3, and illustrating a state in which the fastening portion of the terminal is crimped to the electric wire using the crimping jig.

Next, as shown in FIG. 5, the first crimper 70 and the second crimper 80 located above the first anvil 100 and the second anvil 110 are integrally lowered so as to approach the first anvil 100 and the second anvil 110 (a crimping step). In the process in which the first crimper 70 and the second crimper 80 are lowered, the pair of fastening pieces 42 of the first fastening portion 40 are deformed (fastened) into a curved shape while being guided by the fastening surface 73 of the first crimper 70, and the pair of fastening pieces 62 of the second fastening portion 60 are deformed (fastened) into a curved shape while being guided by the fastening surface 83 of the second crimper 80.

When the first crimper 70 and the second crimper 80 are lowered to predetermined positions, the crimping of the first fastening portion 40 to the conductor core wire 11 by the pair of fastening pieces 42 and the crimping of the second fastening portion 60 to the insulating coating 12 by the pair of fastening pieces 62 are completed, and thus the crimping of the terminal 20 to the electric wire 10 is completed (see FIG. 5).

Here, since the interval D1 is larger than the interval D2 (see FIG. 6A), the terminal 20 is crimped to the electric wire 10 such that the width of the bottom portion 41 of the first fastening portion 40 after crimping is larger than the width of the bottom portion 61 of the second fastening portion 60 after crimping. Therefore, the intermediate portion 50 of the terminal 20 has the shape in which the width thereof decreases from the first fastening portion 40 toward the second fastening portion 60.

At a predetermined stage where the second crimper 80 is being lowered, the inclined surface 84 of the second crimper 80 faces (comes into contact with) the outer surfaces of the pair of end portions of the intermediate portion 50 of the terminal 20 in the width direction. Therefore, from this stage to a crimping completion stage, the inclined surface 84 of the second crimper 80 moves (slides) downward while being in contact with the pair of outer surfaces of the intermediate portion 50. Therefore, at the crimping completion stage, as shown in FIGS. 1A and 1B, sliding marks 51 extending in the up-down direction may be formed on the pair of outer surfaces (an outer surface of the plating material) of the intermediate portion 50.

In this respect, in this example, since the inclined surface 84 is formed, a contact pressure applied to the intermediate portion 50 of the terminal 20 by the boundary portion between the fastening surface 83 and the front surface 81 of the second crimper 80 is smaller than that in a case of using a crimper without the inclined surface 84 (for example, a crimper having a sharp square boundary between the fastening surface 83 and the front surface 81). Therefore, although the sliding marks 51 may have minute concave portions having various recessed shapes, any of the concave portions has a depth such that the base material of the terminal 20 is not exposed. That is, it is possible to prevent a scratch having a large depth such that the base material of the terminal 20 is exposed from being generated in the intermediate portion 50 of the terminal 20. With the sliding marks 51 of this level, it is extremely unlikely that the concave portion grows into a crack during actual use, and there is no concern about damage to the terminal due to vibration or the like during use.

From the viewpoint of reducing the contact pressure applied to the intermediate portion 50 of the terminal 20 by the second crimper 80, it is preferable that the pair of outer surfaces of the intermediate portion 50 and the inclined surface 84 of the second crimper 80 to be in contact with the outer surfaces are substantially parallel to each other. In other words, when viewed from above, it is preferable that an inclination angle of the outer surfaces of the intermediate portion 50 with respect to the front-rear direction is substantially equal to an inclination angle of the inclined surface 84 of the second crimper 80 to be in contact with the outer surfaces with respect to the front-rear direction.

Functions and Effects

As described above, according to the electric wire with terminal 1 in the embodiments of the present invention, the terminal 20 is crimped to the electric wire 10 such that a width of the first fastening portion 40 crimped to the conductor core wire 11 of the electric wire 10 is larger than a width of the second fastening portion 60 crimped to the insulating coating 12 of the electric wire 10. Therefore, the intermediate portion 50 of the terminal 20 has the shape in which the width thereof decreases from the first fastening portion 40 toward the second fastening portion 60. The second crimper 80 of the crimping jig 4 includes the inclined surface 84 inclined so as to chamfer the boundary portion between the fastening surface 83 for guiding and fastening the second fastening portion 60 at the time of crimping and the front surface 81 facing the first crimper 70. The inclined surface 84 faces the intermediate portion 50 of the terminal 20 at the time of crimping. Therefore, the contact pressure applied to the intermediate portion 50 of the terminal 20 by the second crimper 80 is smaller than that in the case of using the crimper without the inclined surface 84 (for example, the crimper having the sharp square boundary between the fastening surface 83 and the front surface 81). Therefore, it is possible to prevent a scratch (for example, a scrape having a depth such that the plating material on the surface of the terminal 20 is penetrated and the base material is exposed) from being generated in the intermediate portion 50 due to the contact with the second crimper 80.

As a result, although the sliding marks 51 formed in the intermediate portion 50 may have the minute concave portions having various recessed shapes, any of the concave portions has a recess depth such that the base material is not exposed. Therefore, unlike a scratch having a large recess depth such that the base material is exposed, there is no concern about damage to the terminal 20 during use due to such a concave portion. As a result, the electric wire with terminal 1 can improve reliability of electrical connection between the terminal 20 and the conductor core wire 11.

Other Embodiments

The present invention is not limited to the above embodiments, and various modifications can be adopted within the scope of the present invention. For example, the present invention is not limited to the above embodiments, and modifications, improvements, and the like can be made as appropriate. In addition, materials, shapes, dimensions, numbers, arrangement positions, and the like of the respective constituent elements in the above embodiments are optional and are not limited as long as the present invention can be achieved.

Figure 7:
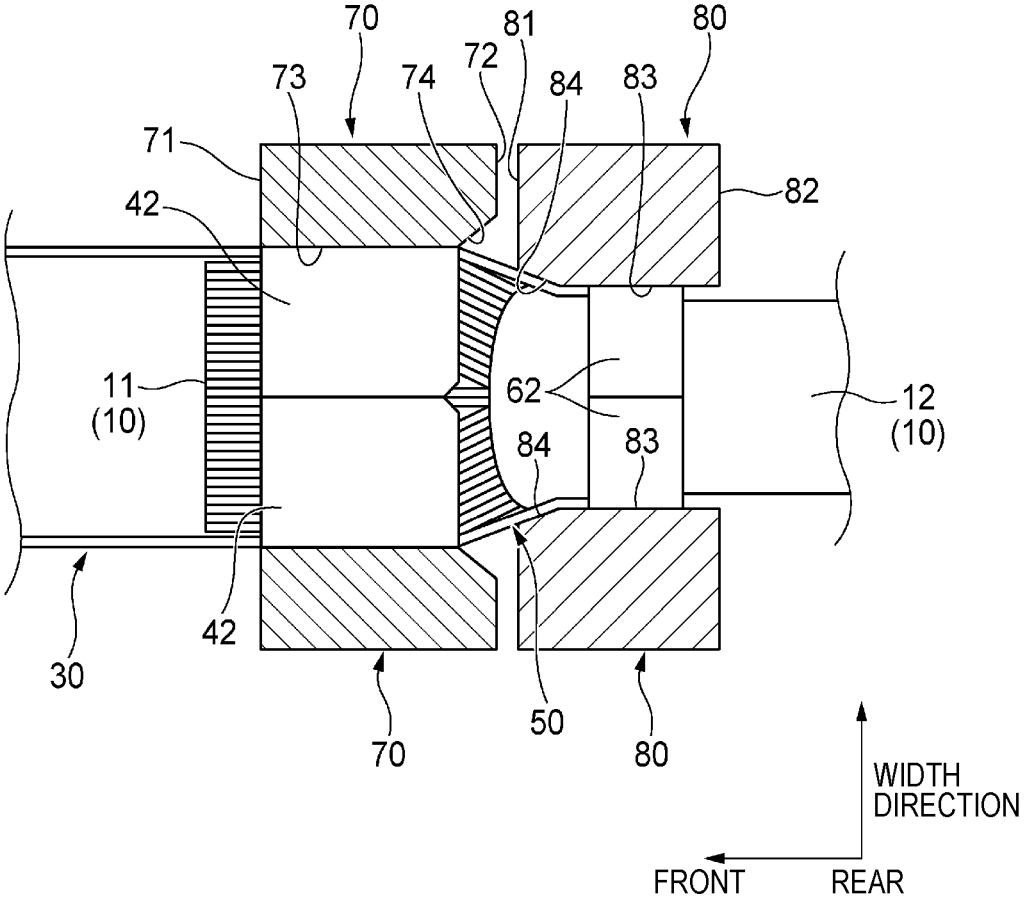
FIG. 7 is a view corresponding to FIG. 6A according to a modification.

For example, in the above embodiments, as shown in FIGS. 3 and 6A, the first crimper 70 and the second crimper 80 are arranged adjacently in the front-rear direction such that the rear surface 72 of the first crimper 70 and the front surface 81 of the second crimper 80 are in contact with each other. In contrast, as shown in FIG. 7, the first crimper 70 and the second crimper 80 may be arranged adjacently in the front-rear direction such that a gap exists between the rear surface 72 of the first crimper 70 and the front surface 81 of the second crimper 80. Also in this case, as in the above embodiments, as long as the inclined surface 84 of the second crimper 80 faces the intermediate portion 50 of the terminal 20 at the time of crimping, the contact pressure applied to the intermediate portion 50 of the terminal 20 by the second crimper 80 is smaller than that in the case of using the crimper without the inclined surface 84. As a result, it is possible to prevent a scratch from being generated in the intermediate portion 50 due to the contact with the second crimper 80.

Here, the features of the embodiments of the manufacturing method of the electric wire with terminal 1, the manufacturing device of the electric wire with terminal 1, and the electric wire with terminal 1 according to the present invention described above will be briefly summarized and listed in [1] to [3] below, respectively.

[1]

A manufacturing method of an electric wire with terminal, the method being used for manufacturing an electric wire with terminal (1) in which a terminal (20) is attached to an end of an electric wire (10), in which the electric wire (10) includes a conductor core wire (11) and an insulating coating (12) covering an outer periphery of the conductor core wire (11), the terminal (20) includes a first fastening portion (40) crimped so as to surround the conductor core wire (11), a second fastening portion (60) crimped so as to surround the insulating coating (12), and an intermediate portion (50) connecting the first fastening portion (40) and the second fastening portion (60), the manufacturing method includes:

a preparation step of positioning the electric wire (10) and the terminal (20) such that the conductor core wire (11) is placed on the first fastening portion (40) and the insulating coating (12) is placed on the second fastening portion (60); and a crimping step of crimping the first fastening portion (40) to the conductor core wire (11) and crimping the second fastening portion (60) to the insulating coating (12) while moving a crimping jig (4) in a predetermined movement direction.

the crimping jig (4) includes a first crimper (70) and a second crimper (80) configured to crimp the first fastening portion (40) and the second fastening portion (60), respectively, such that a width of the first fastening portion (40) after crimping is larger than a width of the second fastening portion (60) after crimping in a width direction intersecting the movement direction, the second crimper (80) includes a fastening surface (83) configured to fasten the second fastening portion (60) while guiding the second fastening portion (60) toward the insulating coating (12), a side surface (81) facing the first crimper (70), and an inclined surface (84) expanding in the width direction as approaching the first crimper (70) so as to chamfer a boundary portion between the fastening surface (83) and the side surface (81), and the inclined surface (84) faces the intermediate portion (50) in the crimping step.

[2]

A manufacturing device of an electric wire with terminal, the device being used for manufacturing an electric wire with terminal (1) in which a terminal (20) is attached to an end of an electric wire (10), in which the electric wire (10) includes a conductor core wire (11) and an insulating coating (12) covering an outer periphery of the conductor core wire (11), the terminal (20) includes a first fastening portion (40) crimped so as to surround the conductor core wire (11), a second fastening portion (60) crimped so as to surround the insulating coating (12), and an intermediate portion (50) connecting the first fastening portion (40) and the second fastening portion (60), the manufacturing device includes:

a crimping jig (4) configured to crimp the first fastening portion (40) to the conductor core wire (11) and crimp the second fastening portion (60) to the insulating coating (12) while moving in a predetermined movement direction, the crimping jig (4) includes a first crimper (70) and a second crimper (80) configured to crimp the first fastening portion (40) and the second fastening portion (60), respectively, such that a width of the first fastening portion (40) after crimping is larger than a width of the second fastening portion (60) after crimping in a width direction intersecting the movement direction, the second crimper (80) includes a fastening surface (83) configured to fasten the second fastening portion (60) while guiding the second fastening portion (60) toward the insulating coating (12), a side surface (81) facing the first crimper (70), and an inclined surface (84) expanding in the width direction as approaching the first crimper (70) so as to chamfer a boundary portion between the fastening surface (83) and the side surface (81), and the inclined surface (84) faces the intermediate portion (50) when the first fastening portion (40) and the second fastening portion (60) are crimped.

[3]

An electric wire with terminal (1) in which a terminal (20) is attached to an end of an electric wire (10), in which the electric wire (10) includes a conductor core wire (11) and an insulating coating (12) covering an outer periphery of the conductor core wire (11), the terminal (20) is made of a metal plate material provided with a plating material so as to cover a surface of a base material, and includes a first fastening portion (40) crimped so as to surround the conductor core wire (11), a second fastening portion (60) crimped so as to surround the insulating coating (12), and an intermediate portion (50) connecting the first fastening portion (40) and the second fastening portion (60), and the intermediate portion (50) has, on a surface of the plating material, a sliding mark (51) that extends along a circumferential direction surrounding the electric wire (10) and does not expose the base material.

According to the manufacturing method of an electric wire with terminal in the configuration of [1], a terminal is crimped to an electric wire such that a width of a first fastening portion (so-called front leg) crimped to a conductor core wire of the electric wire is larger than a width of a second fastening portion (so-called rear leg) crimped to an insulating coating of the electric wire. Therefore, an intermediate portion (so-called front-rear leg connecting portion) of the terminal has a shape in which a width thereof decreases from the first fastening portion toward the second fastening portion. A second crimper of a crimping jig includes an inclined surface having a shape such that a boundary portion between a fastening surface for guiding and fastening the second fastening portion at the time of crimping and a side surface facing a first crimper is chamfered. The inclined surface faces the intermediate portion of the terminal at the time of crimping. Therefore, a contact pressure applied to the intermediate portion of the terminal by the second crimper is smaller than that in a case of using a crimper having no inclined surfaces (for example, a crimper having a sharp square boundary between the fastening surface and the side surface). As a result, it is possible to prevent a scratch (for example, a scrape having a depth such that a plating material on a surface of the terminal is penetrated and a base material is exposed) from being generated in the intermediate portion due to the contact with the second crimper. Therefore, the manufacturing method in this configuration can improve reliability of electrical connection between the terminal and the electric wire by preventing the scratch from being generated in the terminal at the time of crimping.

According to the manufacturing device of an electric wire with terminal in the configuration of [2], a terminal is crimped to an electric wire such that a width of a first fastening portion (so-called front leg) crimped to a conductor core wire of the electric wire is larger than a width of a second fastening portion (so-called rear leg) crimped to an insulating coating of the electric wire. Therefore, an intermediate portion (so-called front-rear leg connecting portion) of the terminal has a shape in which a width thereof decreases from the first fastening portion toward the second fastening portion. A second crimper of a crimping jig includes an inclined surface having a shape such that a boundary portion between a fastening surface for guiding and fastening the second fastening portion at the time of crimping and a side surface facing a first crimper is chamfered. The inclined surface faces the intermediate portion of the terminal at the time of crimping. Therefore, a contact pressure applied to the intermediate portion of the terminal by the second crimper is smaller than that in a case of using a crimper having no inclined surfaces (for example, a crimper having a sharp square boundary between the fastening surface and the side surface). As a result, it is possible to prevent a scratch (for example, a scrape having a depth such that a plating material on a surface of the terminal is penetrated and a base material is exposed) from being generated in the intermediate portion due to the contact with the second crimper. Therefore, the manufacturing device in this configuration can improve reliability of electrical connection between the terminal and the electric wire by preventing the scratch from being generated in the terminal when the terminal is attached to the electric wire.

According to the electric wire with terminal in the configuration of [3], a terminal has a shape in which a width of a first fastening portion (so-called front leg) crimped to a conductor core wire of an electric wire is larger than a width of a second fastening portion (so-called rear leg) crimped to an insulating coating of the electric wire. On an outer surface of a plating material of an intermediate portion (so-called front-rear leg connecting portion) of the terminal, a sliding mark that extends along a circumferential direction surrounding the electric wire and does not expose a base material is formed. The sliding mark may occur when the terminal is crimped to the electric wire by a crimping jig. Although the sliding mark may have minute concave portions having various recessed shapes, any of the concave portions has a depth such that the base material is not exposed, and thus unlike the above scratch, it is extremely unlikely that such a concave portion grows into a crack during actual use, and there is no concern about damage to the terminal. Therefore, the electric wire with terminal in this configuration can improve reliability of electrical connection between the terminal and the conductor core wire.

According to the present invention, it is possible to provide a manufacturing method of an electric wire with terminal, a manufacturing device of an electric wire with terminal, and an electric wire with terminal, which can improve reliability of electrical connection between a terminal and an electric wire.

What is claimed is:

1. A manufacturing method of an electric wire with terminal, the method being used for manufacturing an electric wire with terminal in which a terminal is attached to an end of an electric wire, wherein the electric wire includes a conductor core wire and an insulating coating covering an outer periphery of the conductor core wire, and the terminal includes a first fastening portion crimped so as to surround the conductor core wire, a second fastening portion crimped so as to surround the insulating coating, and an intermediate portion connecting the first fastening portion and the second fastening portion, the manufacturing method comprises:

a preparation step of positioning the electric wire and the terminal such that the conductor core wire is placed on the first fastening portion and the insulating coating is placed on the second fastening portion; and a crimping step of crimping the first fastening portion to the conductor core wire and crimping the second fastening portion to the insulating coating while moving a crimping jig in a predetermined movement direction, the crimping jig includes a first crimper and a second crimper configured to crimp the first fastening portion and the second fastening portion, respectively, such that a width of the first fastening portion after crimping is larger than a width of the second fastening portion after crimping in a width direction intersecting the movement direction, the second crimper includes a fastening surface configured to fasten the second fastening portion while guiding the second fastening portion toward the insulating coating, a side surface facing the first crimper, and an inclined surface expanding in the width direction as approaching the first crimper so as to chamfer a boundary portion between the fastening surface and the side surface, and the inclined surface faces the intermediate portion in the crimping step.

2. The manufacturing method of an electric wire with terminal according to claim 1, wherein the intermediate portion of the terminal has a shape in which the width thereof decreases from the first fastening portion toward the second fastening portion, and the pair of outer surfaces of the intermediate portion and the inclined surface of the second crimper to be in contact with the outer surfaces are substantially parallel to each other.

3. A manufacturing device of an electric wire with terminal, the device being used for manufacturing an electric wire with terminal in which a terminal is attached to an end of an electric wire, wherein the electric wire includes a conductor core wire and an insulating coating covering an outer periphery of the conductor core wire, the terminal includes a first fastening portion crimped so as to surround the conductor core wire, a second fastening portion crimped so as to surround the insulating coating, and an intermediate portion connecting the first fastening portion and the second fastening portion, the manufacturing device comprises:

a crimping jig configured to crimp the first fastening portion to the conductor core wire and crimp the second fastening portion to the insulating coating while moving in a predetermined movement direction, the crimping jig includes a first crimper and a second crimper configured to crimp the first fastening portion and the second fastening portion, respectively, such that a width of the first fastening portion after crimping is larger than a width of the second fastening portion after crimping in a width direction intersecting the movement direction, the second crimper includes a fastening surface configured to fasten the second fastening portion while guiding the second fastening portion toward the insulating coating, a side surface facing the first crimper, and an inclined surface expanding in the width direction as approaching the first crimper so as to chamfer a boundary portion between the fastening surface and the side surface, and the inclined surface faces the intermediate portion when the first fastening portion and the second fastening portion are crimped.

4. The manufacturing method of an electric wire with terminal according to claim 3, wherein the intermediate portion of the terminal has a shape in which the width thereof decreases from the first fastening portion toward the second fastening portion, and the pair of outer surfaces of the intermediate portion and the inclined surface of the second crimper to be in contact with the outer surfaces are substantially parallel to each other.

5. An electric wire with terminal, comprising:

an electric wire; and a terminal attached to an end of the electric wire, wherein the electric wire includes a conductor core wire and an insulating coating covering an outer periphery of the conductor core wire, the terminal is made of a metal plate material provided with a plating material so as to cover a surface of a base material, and includes a first fastening portion crimped so as to surround the conductor core wire, a second fastening portion crimped so as to surround the insulating coating, and an intermediate portion connecting the first fastening portion and the second fastening portion, and the intermediate portion has, on a surface of the plating material, a sliding mark that extends along a circumferential direction surrounding the electric wire and does not expose the base material, and the sliding mark includes at least one recessed portion extending into the plating material.

6. The manufacturing method of an electric wire with terminal according to claim 5, wherein the intermediate portion of the terminal has a shape in which the width thereof decreases from the first fastening portion toward the second fastening portion.

* * * * *